US007905482B2

(12) United States Patent
Matsumoto

(10) Patent No.: US 7,905,482 B2
(45) Date of Patent: Mar. 15, 2011

(54) RECORDING APPARATUS

(75) Inventor: Toshiya Matsumoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 328 days.

(21) Appl. No.: 11/781,347

(22) Filed: Jul. 23, 2007

(65) Prior Publication Data

US 2008/0048387 A1 Feb. 28, 2008

(30) Foreign Application Priority Data

Aug. 23, 2006 (JP) ..... 2006-226565

(51) Int. Cl.
*B65H 31/04* (2006.01)

(52) U.S. Cl. ..... 271/213; 271/207; 399/405

(58) Field of Classification Search ..... 271/213, 271/207, 162, 164; 347/104; 399/405
See application file for complete search history.

(56) References Cited

U.S. PATENT DOCUMENTS

| | | | | |
|---|---|---|---|---|
| 5,765,825 | A * | 6/1998 | Watase | 271/9.13 |
| 7,070,350 | B2 * | 7/2006 | Inokuchi et al. | 400/680 |
| 2006/0284363 | A1 | 12/2006 | Matsumoto et al. | 271/10.11 |
| 2007/0001382 | A1 | 1/2007 | Matsumoto et al. | 271/162 |

FOREIGN PATENT DOCUMENTS

| | | |
|---|---|---|
| JP | 2004-82473 | 3/2004 |
| JP | 2004-082478 | 3/2004 |
| JP | 2005-074659 | 3/2005 |

* cited by examiner

*Primary Examiner* — Stefanos Karmis
*Assistant Examiner* — Michael C McCullough
(74) *Attorney, Agent, or Firm* — Fitzpatrick, Cella, Harper & Scinto

(57) ABSTRACT

A recording apparatus includes a discharging roller for discharging, from a main assembly of the apparatus, a recording material having been subjected to a recording operation by recording means; an openable and closable sheet discharge tray for supporting the recording material discharged by the discharging roller; locking means for holding the sheet discharge tray at a closed position; drive transmitting means for transmitting a driving force to release the locking means in interrelation with main assembly driving means; and advancing and retracting means for advancing and retracting the drive transmitting means relative to the main assembly driving means in interrelation with a position of the sheet discharge tray, wherein the locking means is effective to release the locking means by the main assembly driving means so as to permit the drive transmitting means to retract away from the main assembly driving means by a weight of the sheet discharge tray and an urging force of urging means when the sheet discharge tray is at the closed position.

4 Claims, 14 Drawing Sheets

RECORDING APPARATUS

FIELD OF THE INVENTION AND RELATED ART

The present invention relates to a recording apparatus which records on recording medium with the use of recording means, based on picture information. More specifically, it relates to a recording apparatus equipped with a mechanism for automatically unfolding a delivery tray.

A recording apparatus, such as a printer, a copying machine, a facsimile machine, etc., is structured to record an image on recording medium, such as recording paper, etc., based on picture information. As recording methods employed by a recording apparatus, there are various methods, for example, the thermal transfer method, thermal method, ink jet recording method, laser beam recording method, wire-dot recording method, etc. As for recording media, there are also various media, for example, paper, fabric, plastic sheet, OHP sheet, envelop, etc. In other words, anything can be used as recording medium as long as an image is recordable thereon. Further, recording apparatuses of various types have come to be used as the means for printing a text or pictorial image based on information sent from a personal computer, a digital camera, or the like.

A recording apparatus is provided with a delivery tray, which is for preventing the sheets of recording medium from changing in order after printing, preventing the sheets of recording medium (copies) from being soiled by falling to the floor, and/or preventing the like problems. A delivery tray is required to hold various recording media, as well as multiple sheets of recording medium, in an orderly fashion. Therefore, its size (length as well as width) needs to be greater than a certain value. Thus, in recent years, a delivery tray has been made foldable so that when it is not in use, it can be kept folded. Making the delivery tray of a recording apparatus foldable can reduce the recording apparatus in the amount of space the recording apparatus occupies when the apparatus is not in use, and also, can improve the appearance of the recording apparatus when it is not in use. It also can protect the interior of the recording apparatus from dust or the like.

However, a foldable delivery tray has the following problem: If a recording apparatus equipped with foldable delivery tray is operated with the tray remaining in the folded state, recording mediums are prevented from being discharged from the apparatus, becoming therefore jammed in the apparatus, after recording is made thereon. As the means for solving this problem, Japanese Laid-open Patent Application 2004-82473 discloses a recording apparatus which is provided with a sensor for detecting the state of its delivery tray (whether or not delivery tray is in the folded state), so that a warning is issued, or the on-going printing operation is interrupted. Further, Japanese Laid-open Patent Application 2005-74659 discloses a recording apparatus structured so that its delivery tray is automatically unfolded by a delivery tray operating power source, such as a solenoid, dedicated to the tray, as soon as the power source of the recording apparatus is turned on, or in response to a command for starting a printing operation.

However, the automatically unfoldable delivery trays, such as the abovementioned ones, which are in accordance with the prior art suffer from the following problems. That is, they require a dedicated sensor, a dedicated driving power source, and the wiring therefor, and therefore, providing a recording apparatus with an automatically unfolding delivery tray in accordance with the prior art substantially increases the apparatus cost. In other words, only an expensive recording apparatus can be equipped with an automatically unfolding delivery tray. As one of the means for keeping the cost of a recording apparatus equipped with an automatically unfolding delivery tray as low as possible, it is possible to employ a solenoid as the driving force source. However, the employment of a solenoid has its own problem, because a solenoid generates loud noises as it is driven.

A recording apparatus which is provided with a sensor for detecting the state (whether its delivery tray is in folded or unfolded state) of its delivery tray so that a warning can be issued or the ongoing printing operation can be interrupted, is relatively low in cost. However, it suffers from the following two problems. The first one is that the delivery tray is difficult to operate: the tray must be manually unfolded by an operator after a warning is issued or the ongoing printing operation is interrupted. In particular, in the case in which a printing operation is carried out by a recording apparatus which is located away from an operator and must be remote-controlled, manually unfolding the delivery tray of the recording apparatus becomes an operation which is extremely troublesome (requires time and labor). Secondly, simply interrupting the ongoing printing operation or issuing a warning is insufficient to ensure that an operator will be prompted to unfold the delivery tray, sometimes causing the operator to erroneously think that the recording apparatus main assembly itself is having a problem.

Further, in the case of a delivery tray which is large in the angle by which it has to be rotated into the unfolded position, there is the problem that a large collisional noise is created at the end of the operation for unfolding the delivery tray. As the means for preventing the occurrence of this large collisional noise, it is possible to provide the delivery tray stopper portion of the recording apparatus main assembly with a shock absorbing member, such a piece of sponge. However, the provision of the shock absorbing member reduces the delivery tray in the positional and attitudinal accuracy, which in turn reduces the recording apparatus in the accuracy with which the recording apparatus records. As another means for reducing the large collisional noise, it is possible to employ an oil-filled damper. However, the employment of an oil-filled damper substantially increases in cost and size a recording apparatus equipped with a foldable delivery tray.

SUMMARY OF THE INVENTION

The primary object of the present invention is to provide a recording apparatus which is optimal in the amount of the moment which its delivery tray gains as the delivery tray is unfolded, the delivery tray of which automatically opens, and which is slower in the speed at which its delivery tray is unfolded, being therefore substantially smaller in the collisional noise which occurs at the end of the unfolding of the delivery tray, than recording apparatuses in accordance with the prior art.

According to an aspect of the present invention, there is provided a recording apparatus comprising a discharging roller for discharging, from a main assembly of said apparatus, a recording material having been subjected to a recording operation by recording means; an openable and closable sheet discharge tray for supporting the recording material discharged by said discharging roller; locking means for holding said sheet discharge tray at a closed position; drive transmitting means for transmitting a driving force to release said locking means in interrelation with main assembly driving means; and advancing and retracting means for advancing and retracting said drive transmitting means relative to said main assembly driving means in interrelation with a position of said sheet discharge tray, wherein said locking means is effective to release said locking means by said main assembly driving means so as to permit said drive transmitting means to retract away from said main assembly driving means by a weight of said sheet discharge tray and an urging force of urging means when said sheet discharge tray is at the closed position.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

Hereinafter, the preferred embodiments of the present invention will be concretely described with reference to the appended drawings. Incidentally, if a given component in one of the drawings is designated with the same referential numerals or characters as those designating a component in another drawing, the two components are identical or correspond to each other.

Figure 1:
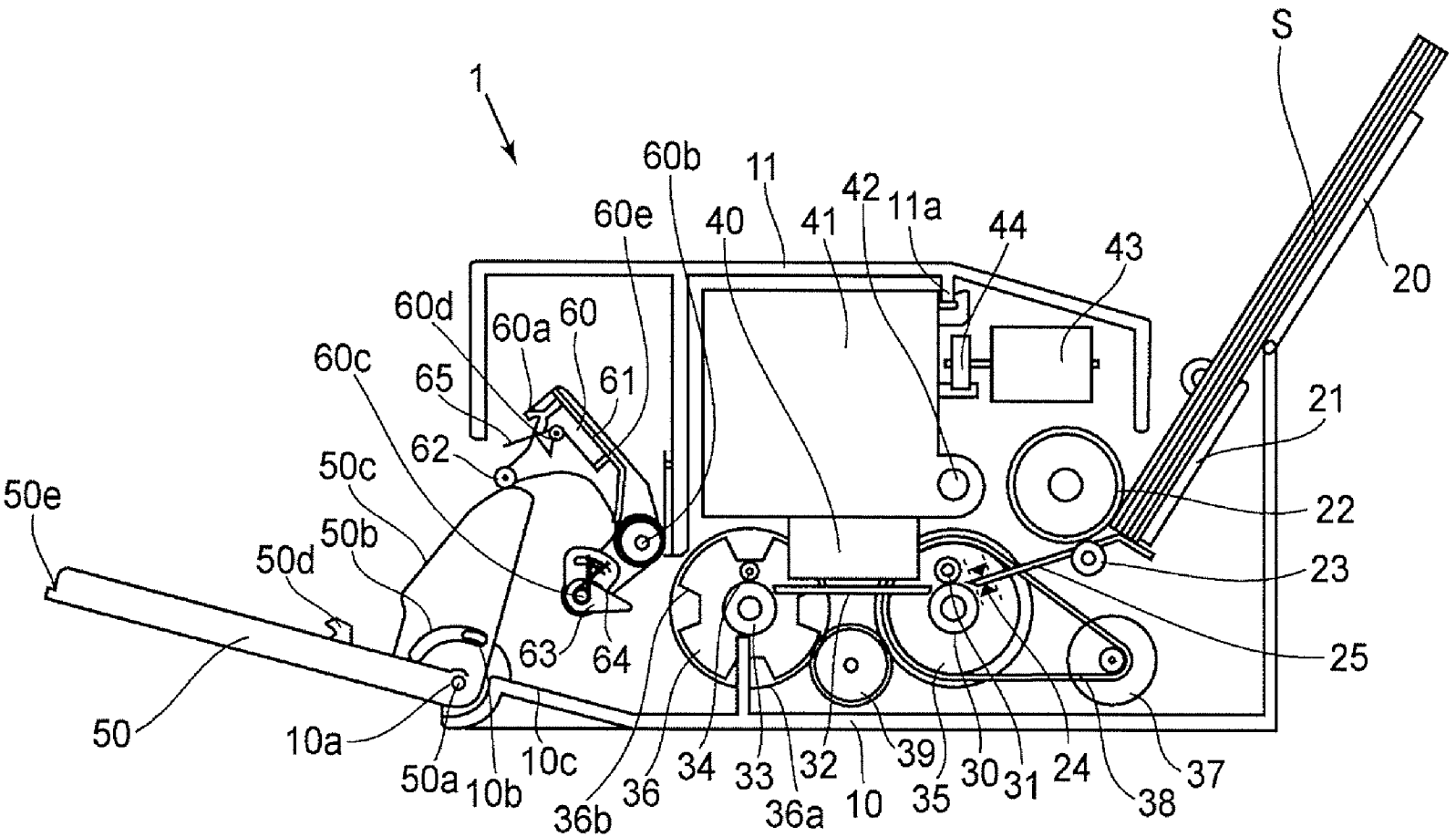
FIG. 1 is a vertical sectional view of the recording apparatus, in the first preferred embodiment of the present invention, the delivery tray of which is in the unfolded state, showing the general structure of the apparatus.
Figure 2:
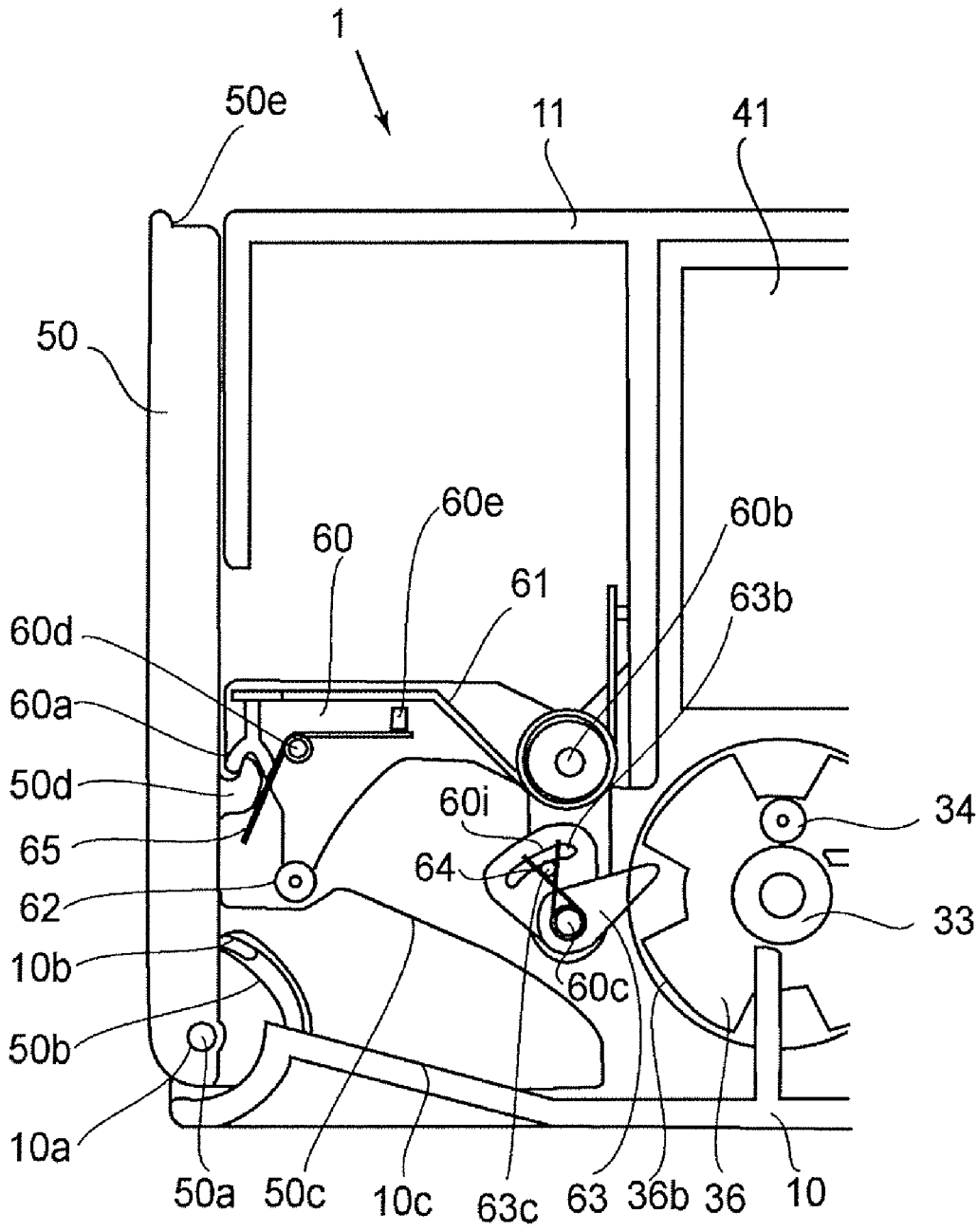
FIG. 2 is a vertical sectional view of the delivery tray of the recording apparatus, in the first preferred embodiment of the present invention, which is in the folded state, and the components related to the delivery tray operation.

FIG. 1 is a vertical sectional view of the recording apparatus in the first preferred embodiment of the present invention, and shows the general structure of the recording apparatus, the delivery tray of which is in the unfolded state. FIG. 2 is a vertical sectional view of the same recording apparatus as the one shown in FIG. 2, except that in FIG. 2, the delivery tray of the apparatus is in the folded state.

The recording apparatus 1 in this embodiment is an ink jet recording apparatus. It is provided with bottom and top frames 10 and 11, respectively. A portion of the bottom frame 10 and a portion of the top frame 11 make up the external shell (housing) of the recording apparatus 1. The bottom and top frames 10 and 11 are solidly fixed to each other by their unshown outer edge portions. The recording apparatus 1 is provided with a sheet feeding portion for feeding recording medium, such as recording paper, to the image forming portion. The sheet feeding portion is located behind the rear end of the bottom frame 10. The sheet feeding portion is provided with: a sheet feeder tray 20, which can be folded or unfolded; a pressure plate 21 which is movable in an oscillatory manner; a sheet feeder roller 22 which is rotatable; a sheet separator roller 23 which is kept pressed upon the sheet feeder roller 22, and is rotated by the rotation of the sheet feeder roller 22; and a sheet guide 25 provided with a sheet sensor 24.

A recording medium S is in the sheet feeder tray 20; multiple recording mediums S are stacked in the sheet feeder tray 20, with the bottommost recording medium S being in contact with the pressure plate 21. More specifically, as the sheet feeder tray 20 is unfolded, the recording medium bearing surface of the sheet feeder tray 20 becomes roughly flush with the recording medium bearing surface of the pressure plate 21, which is tilted. Thus, a stack of recording mediums S is placed in the sheet feeder tray 20 so that the bottommost recording medium S comes into contact with both the recording medium bearing surface of the sheet feeder tray 20 and the recording medium bearing surface of the pressure plate 21. The pressure plate 21 and sheet feeder roller 22 are driven by an unshown sheet feeder roller motor. The position of the pressure plate 21 and the rotation of the sheet feeder roller 22 are controlled by an unshown control cam. The sheet separator roller 23 is provided with an internal torque limiter (unshown) so that the sheet separator roller 23 rotates only when the amount of torque to which it is being subjected is greater than a preset value.

The recording apparatus 1 is also provided with: a recording head 40 which makes up the image forming portion; and a platen 32. The recording head 40 and platen 32 are located roughly in the center portion of the bottom frame 10. The recording head 40 makes up the recording means which records an image on the recording medium S, based on picture information. The platen 32 is positioned so that it opposes the recording head 40. It is a component which guides and supports the recording medium S so that the recording medium S directly faces the recording head 40. Further, the recording apparatus 1 is provided with a sheet conveyer roller 30, a pinch roller 31, and a sheet guide 25. In terms of the recording medium conveyance direction, the sheet conveyer roller 30 and pinch roller 31 are on the upstream side of the platen 32, and on the downstream side of the sheet guide 25. The pinch roller 31 is kept pressed upon the sheet conveyer roller 30 and is rotated by the rotation of the sheet conveyer roller 30. The recording apparatus 1 is also provided with a pair of spur-like wheels 34, which are on the downstream side of the platen 32. The spur-like wheel 34 is kept pressed upon the corresponding sheet discharger roller of a pair of sheet discharger rollers, and is rotatable by the rotation of the sheet discharger roller. The sheet discharger rollers 33 and spur-like wheels 34 make up a discharging means for discharging the recording medium S from the apparatus main assembly.

The recording head 40 is mounted on a carriage 41 which is movable above the platen 32 in the direction (primary scan direction) parallel to the width direction of the recording medium S. The carriage 41 is supported by a guide shaft 42 and a guide rail 11*a*, which are parallel to the shaft of the sheet conveyer roller 30 and the shaft of the sheet discharger roller 33, in such a manner that it can be reciprocally movable along the guide shaft 42 and guide rail 11*a*. The guide rail 11*a* is integral with the top frame 11. The carriage 41 is driven by a carriage motor 34 as the carriage driving force source, through a timing belt 44 suspended by an unshown motor pulley and an unshown idler pulley. The recording head 40 is in connection with an unshown FFC (flexible flat cable) for transmitting signals and electric power between the apparatus main assembly and recording head substrate.

This recording apparatus is structured to record an image by jetting ink from the ink jetting orifices of the recording head 40, onto the recording medium S, based on picture information. The ink jet recording head 40 in this embodiment, which may serve as ink jet recording means, selectively drives the heaters located inward of the ink jetting orifices to jet ink droplets. More specifically, as each of the selected heaters is heated, the body of ink in the corresponding ink jetting orifice is boiled by the heat. More specifically, bubbles grow and collapse, changing therefore the internal pressure in the orifice. This pressure change is utilized to jet ink droplets from the orifice. The recording head 40 is in connection with an ink container, which is removably attached to the recording head 40.

The sheet conveyer roller 30 and sheet discharger rollers 33 are synchronously driven by a sheet conveyance motor 37. The sheet conveyer roller 30 is provided with a sheet conveyer roller gear 35, which is solidly attached to one of the lengthwise ends of the shaft of the sheet conveyer roller 30. The sheet discharger roller 33 is provided with a sheet discharger roller gear 36, which is solidly attached to one of the lengthwise ends of the shaft of the sheet discharger roller 33. The sheet discharger roller gear 36 is provided with a gear portion 36*a* and a cam portion 36*b*. The sheet conveyer roller gear 35 and the gear portion 36*b* of the sheet discharger roller gear 36 are in connection with each other through a transmission gear 39. The sheet conveyance motor 37 and sheet conveyer roller gear 35 are in connection with each other through a sheet conveyer belt 38 suspended by the pulleys, so that driving force can be transmitted from the sheet conveyance motor 37 to the sheet conveyer roller gear 35. Thus, as driving force is transmitted to the sheet conveyer roller gear 35 through the sheet conveyer belt 38, the sheet conveyer roller 30 is rotationally driven. At the same time, the rotation of the sheet conveyer roller gear 35 is transmitted to the sheet discharger roller gear 36 through the transmission gear 39 and gear portion 36*a*. Thus, as driving force is transmitted to the sheet conveyer roller gear 35, the sheet discharger roller 33 is also rotationally driven in synchronism with the sheet conveyer roller 30.

Next, referring to FIG. 1, the operation of the recording apparatus 1 will be described. As a record start command is issued, the pressure plate 21 is oscillated by the unshown sheet feeder motor. As a result, the stack of recording mediums S in the sheet feeder tray is pressed upon the sheet feeder roller 22. Thus, several recording mediums S on the sheet feeder roller 22 side are sent out from the sheet feeder tray by the rotation of the sheet feeder roller 22. However, the recording mediums S other than the topmost recording medium S are held up by the sheet separator roller 23 which is provided with the torque limiter. Thus, only the topmost recording medium S is conveyed further along the sheet guide 25. Thereafter, the pressure plate 21 is retracted far enough to keep the stack of recording mediums S in the sheet feeder tray separated from the sheet feeder roller 22, and the recording mediums S which were held up by the separator roller 23 are returned to the original location in the sheet feeder tray by an unshown sheet return lever.

Meanwhile, the recording medium S which was sent out along the sheet guide 25 is conveyed further by the rotation of the sheet feeder roller 22 and sheet separator roller 23, and collides into the nip between the sheet conveyer roller 30 and a pinch roller 31, which are remaining stationary. As a result, the recording medium S is made to curve by a preset amount. Thus, the entirety of the leading edge of the recording medium S is placed in contact with the nip by the resiliency of the recording medium S; in other words, the recording medium S is properly aligned. Then, as soon as it is determined, based on the information from the sheet sensor 24, that the recording medium S was conveyed by a preset distance, the sheet conveyer roller 30 begins to be rotationally driven by the sheet conveyance motor 37. The preceding steps described above can correctly position the recording medium S, even if the recording medium S was being conveyed askew. Thereafter, the transmission of driving force to the sheet feeder roller 22 is stopped, and the separator roller 23 is separated from the sheet feeder roller 22. This separation of the separator roller 23 from the sheet feeder roller 22 reduces the excessive amount of forward pressure to which the recording medium S is being subjected while being held by the abovementioned nip. Therefore, the recording medium S is conveyed with a higher level of precision.

After the recording medium S is conveyed a preset distance along the platen 32, it is stopped so that the leading edge of the recording medium S aligns with the image formation position (recording start position) on the platen 32. Then, the carriage 41 is driven by the carriage motor 43 so that the recording head 40 is moved in the primary scan direction while being driven to jet ink from its ink jetting orifices onto the recording medium S, based on picture information. As a result, recording is made by the amount equivalent to a single line, that is, a portion of the intended image, which corresponds to the length of each column of ink jetting orifices of the ink jet recording head. Then, the recording medium S is conveyed by a preset distance (pitch) in the secondary scan direction. The process of recording a portion of the intended image, which corresponds to a single primary scanning line, and the process of conveying the recording medium S in the secondary scan direction, are alternately repeated until the intended image is completed on the recording medium S. After being moved past the platen 32, the recording medium S is pinched between the sheet conveyer roller 30 and the sheet discharger roller 33, which are being synchronously driven, and is discharged from the apparatus main assembly. While the image is being formed, the presence of the trailing edge of the recording medium edge is also detected by the sheet sensor 24 so that recording can be continued until the time of the arrival of the trailing edge of the recording medium S at the image formation position, which can be calculated based on the result of the detection by the sheet sensor 24.

Next, referring to FIGS. 1 and 2, the structure of the mechanism for unfolding or folding the delivery tray of the recording apparatus 1 will be described. A delivery tray 50 into which recording mediums S are accumulated as they are discharged from the apparatus main assembly is attached to the front side of the apparatus main assembly. More specifically, the delivery tray 50 is provided with a pair of shafts 50*a*, which are located at the left and right ends of the tray 50, one for one, whereas the apparatus main assembly is provided with a pair of bearings 10*a*, which are located at the bottom front ends of the apparatus main assembly, one for one. Thus, as the delivery tray 50 is attached to the apparatus main assembly by fitting the pair of shafts 50*a* into the pair of bearings 10*a*, one for one, the delivery tray 50 can be rotationally folded or unfolded relative to the apparatus main assembly. One of the lateral walls of the delivery tray 50 is provided with an arcuate slot 50*b* with a preset length (preset angular range), the center of which coincides with the axial line of the shaft 50*a*. On the other hand, the lateral wall of the bottom frame 10, which corresponds to the lateral wall of the delivery tray 50 having the slot 50*b*, is provided with a projection 10*b*, which fits into the slot 50*a* of the delivery tray 50 so that the projection 10*b* can slide from one end of the slot 50*a* to the other. Thus, as the projection 10*b* of the bottom frame 10 is fitted into the arcuate slot 50*a* of the delivery tray 50, the delivery tray 50 can be rotationally moved between its folded position, or the virtually upright position, shown in FIG. 2, and its unfolded position, or the slight angled position relative to the horizontal direction, shown in FIG. 1.

When the delivery tray 50 is in the unfolded position shown in FIG. 1, the recording mediums can be discharged from the apparatus main assembly into the delivery tray 50 so that they accumulate on the combination of the sheet supporting surface portion 10*c* of the bottom frame 10 and the sheet supporting surface of the delivery tray 50. The abovementioned lateral wall of the delivery tray 50 is provided with a cam portion 50*c* and a hook portion 50*d*, which are outside the space in which the recording mediums are accumulated. Incidentally, in this embodiment, the cam portion 36*b* of the sheet discharger roller gear 36 solidly attached to the sheet discharger roller 33 will be referred to as first cam portion, and the cam portion 50*c* of the delivery tray 50 will be referred to as third cam portion. Further, the hook portion 50*d* will be referred to as second cam portion. The end of the delivery tray 50 is provided with a handhold portion 50*e*.

The rear end portion of the apparatus main assembly is provided with a primary lever 60, which is outside the space in which recording mediums are accumulated. The primary lever 60 is supported by its shaft portion 60*b* by the top frame 11 so that the primary lever 60 can be rotationally moved about the axial line of the shaft portion 60*b*. Further, the primary lever 60 is kept pressured in the counterclockwise direction, shown in the drawing, by a spring 61. The primary lever 60 makes up the driving force transmitting means, which will be described later. The primary lever 60 is provided with a roller 62, which is rotatably attached to the front end of the primary lever 60 by its shaft. The roller 62 functions as a cam follower, which follows the cam portion 50*c* (third cam portion) of the delivery tray 50 while rolling on the cam portion 50*c*. The roller 62 remains in contact with the cam portion 50*c* of the delivery tray 50. It is enabled to follow the cam portion 50*c* of the delivery tray 50 while rolling on the cam portion 50*c* as the delivery tray 50 is unfolded or folded. The cam portion 50*c* of the delivery tray 50 and the roller 62 of the primary lever 60 make up the means for moving forward or backward the primary lever 60 and trigger lever 63, which will be described later.

The primary lever 60 is also provided with a trigger lever 63, which is attached to the opposite end of the primary lever 60 from the roller 62. The trigger lever 63 is rotationally movable about the shaft portion 60*c* of the primary lever 60. The trigger lever 63 is kept pressured by a spring 64 so that it remains at the center of the range of its rotational movement. That is, the resiliency of the spring 64 is strong enough to keep the trigger lever 63 at the center of the range in which the trigger lever 63 is rotationally movable. More specifically, referring to FIGS. 2-5, the dimension of the range (rotational angle) in which the trigger lever 63 is rotationally movable is determined by the engagement between the projection 60*i* of the primary lever 60 and the arcuate slot 63*b* of the trigger lever 63. Further, the spring 64 is made and positioned so that its ends engage with both the projection 63*c* of the trigger lever 63 and the projection 60*i* of the primary lever 60. Thus, as the trigger lever 63 is rotationally displaced by the cam portion 36*b*, the spring 64 is elastically deformed, and then, the primary lever 60 is rotationally displaced. This rotational displacement of the primary lever 60 causes the hook portion 50*d* to disengage from the hook catching portion 60*a* (delivery tray becomes unlocked), which will be described later. In this embodiment, the trigger lever 63, with which the primary lever 60 as the driving force transmitting means is provided makes up the cam follower portion which follows the cam portion 36*b* (first cam portion) of the sheet discharger roller gear 36 of the sheet discharger roller 33 as the driving means on the apparatus main assembly side.

The primary lever 60 is also provided with a pusher spring 65, which may serve as urging means and is attached to the front end of the primary lever 60. The pusher spring 65 is a tortional coil spring, and is attached to the primary lever 60 so that it can rotationally move. One end of the pusher spring 65 projects frontward as an elastic arm. More specifically, the pusher spring 65 is attached to the shaft portion 60*e* of the primary lever 60, being thereby enabled to rotationally move. The pusher spring 65 is made and position so that one of its arm portions is enabled to contact the projection 60*e* of the primary lever 60, and the other is enabled to contact the back surface of the delivery tray 50. When the delivery tray 50 is in the folded position (FIG. 2), the second arm portion is between the delivery tray 50 and the primary lever 60, being thereby chargeable (elastically deformable by application of pressure).

Further, the front end of the primary lever 60 is provided with a hook catching portion 60*a*, which can be engaged with the hook portion 50*d*, which is on the back surface of the delivery tray 50. As the delivery tray 50 is folded, this hook catching portion 60*a* engages with the hook portion 50*d*, and while the delivery tray 50 is in the folded position, the hook catching portion 60*a* remains engaged with the hook portion 50*d*, continuing to apply the force from the spring 61 attached to the primary lever 60, to the delivery tray 50. Therefore, while the delivery tray 50 is in the folded position, it is provided with such a moment that acts in the direction to rotate the delivery tray 50 in the clockwise direction shown in the drawing, about the shaft portion 10*a*, and therefore, the delivery tray 50 remains folded after it is moved into the folded position. That is, the hook catching portion 60*a* of the primary lever 60, which is provided, by the spring 61, with the moment which acts in the direction to cause the primary lever 60 in the counterclockwise direction, is engaged with the hook portion 50*d* of the delivery tray 50. In other words, the spring 61, hook catching portion 60*a*, and hook portion 50*d* make up the locking means for keeping the delivery tray 50 in the folded position (keeping delivery tray 50 locked to apparatus main assembly).

Figure 3:
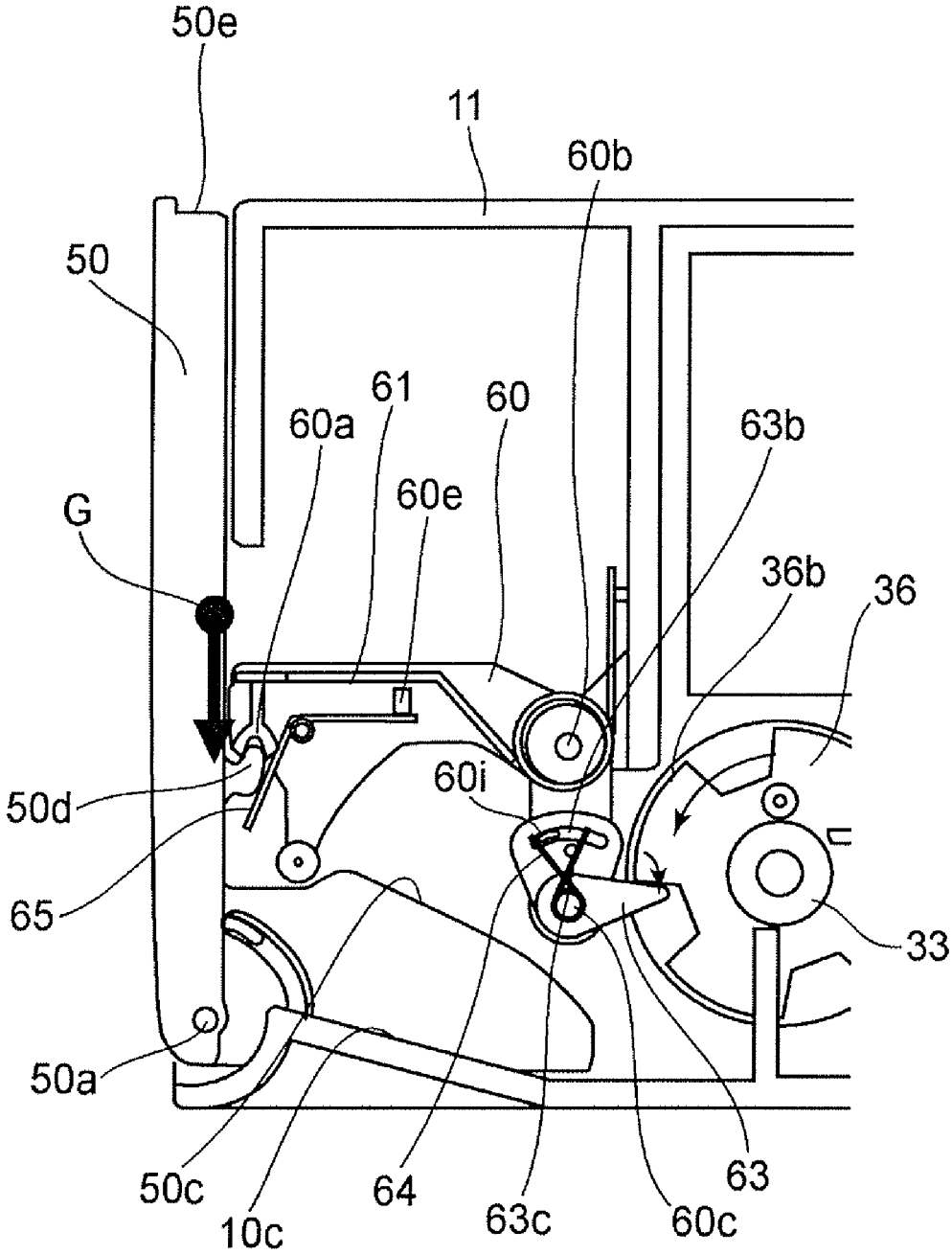
FIG. 3 is a vertical sectional view of the delivery tray of the recording apparatus, in the first preferred embodiment of the present invention, which has just begun to be automatically unfolded, and the components related to the tray operation.
Figure 4:
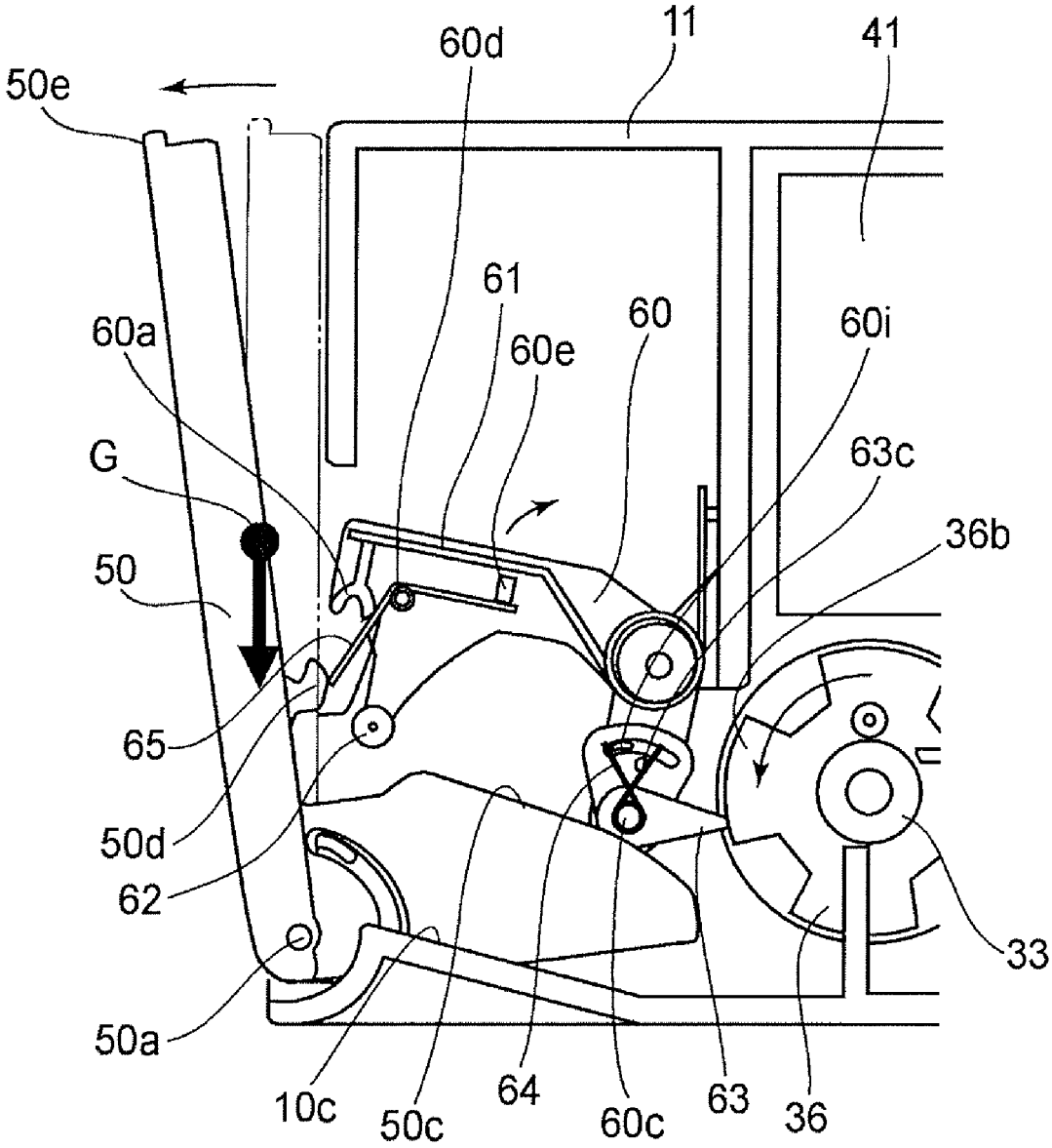
FIG. 4 is a vertical sectional view of the delivery tray of the recording apparatus, in the first preferred embodiment of the present invention, which is being rotated away from the apparatus main assembly about its hinge portion by a pusher spring, and the components related to the tray operation.
Figure 5:
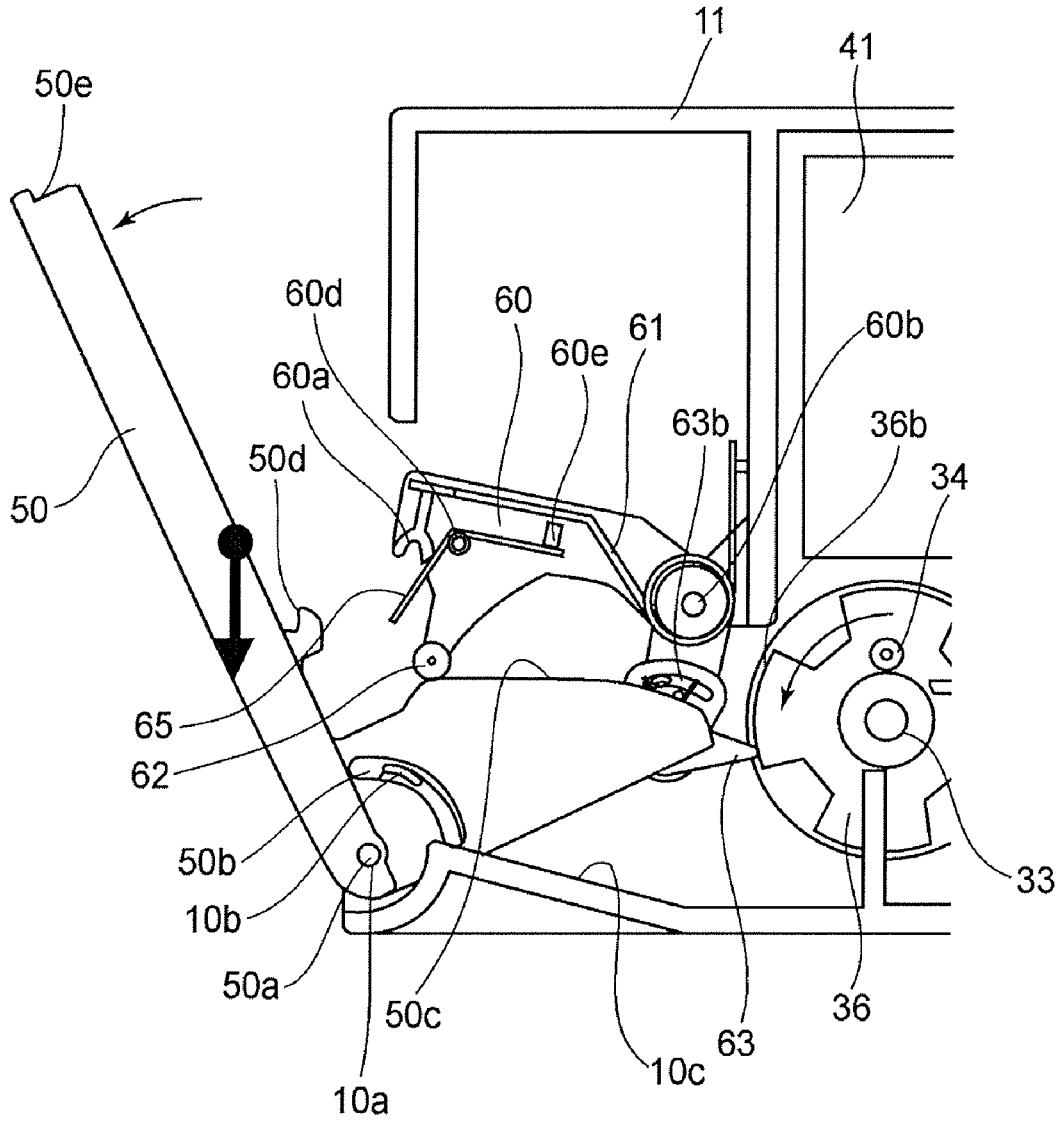
FIG. 5 is a vertical sectional view of the delivery tray of the recording apparatus, in the first preferred embodiment of the present invention, which is being unfolded by its own weight at a slow speed while being subjected to the force which is working in the direction to fold the tray, and the components related to the tray operation.
Figure 6:
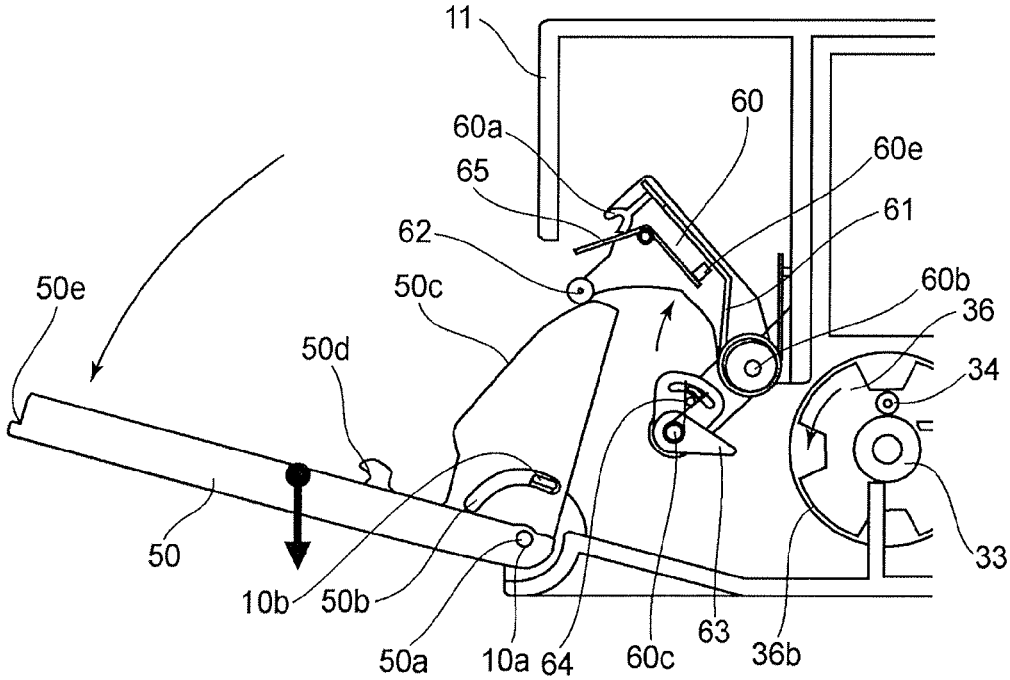
FIG. 6 is a vertical sectional view of the delivery tray of the recording apparatus, in the first preferred embodiment of the present invention, which has just automatically and fully unfolded, and the components related to the tray operation.
Figure 7:
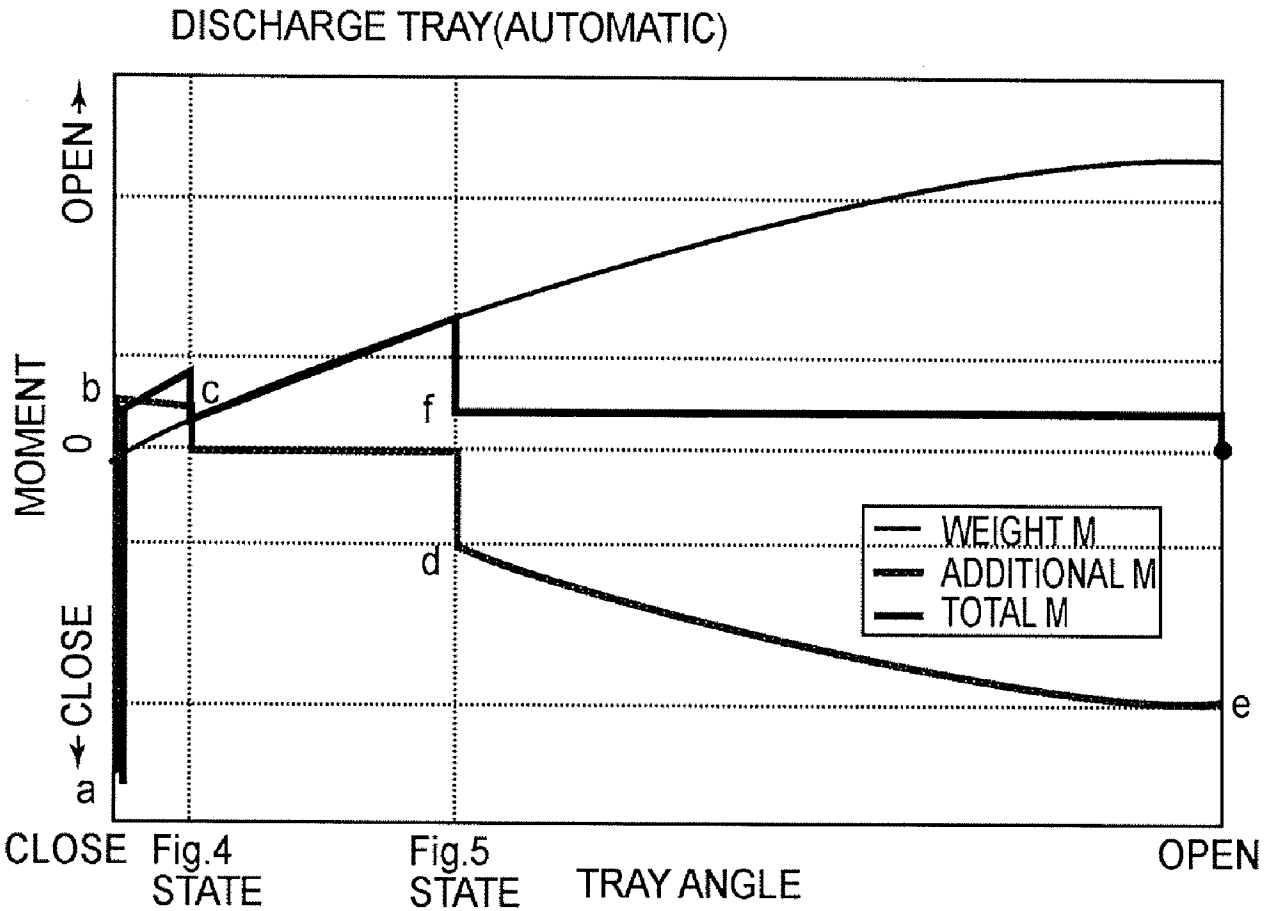
FIG. 7 is a graph showing the relationship between the delivery tray angle (tray position during unfolding or folding of tray) and the moment of the delivery tray.

FIG. 3 is a vertical sectional view of the delivery tray 50 and the components related to the operation of the delivery tray 50, showing the state of the delivery tray 50 and the components before the starting of the operation for automatically unfolding the delivery tray 50. FIG. 4 is a vertical sectional view of the delivery tray 50 and the components related to the operation of the delivery tray 50, showing the state in which the delivery tray 50 and the components are while the delivery tray 50 is rotationally pushed away from the apparatus main assembly by the pusher spring 65. FIG. 5 is a vertical sectional view of the delivery tray 50 and the components related to the operation of the delivery tray 50, showing the state in which the delivery tray 50 and the components are while the delivery tray 50 is unfolded at a slower speed by its own weight alone while remaining under the pressure (moment) which acts in the direction to fold the delivery tray 50. FIG. 6 is a vertical sectional view of the delivery tray 50 and the components related to the operation of the delivery tray 50, showing the state in which the delivery tray 50 and the components are after the unfolding of the delivery tray 50. FIG. 7 is a graph showing the characteristic of the moment with which the delivery tray 50 is provided while the delivery tray 50 is automatically unfolded, or folded, that is, the relationship between the angle of the delivery tray 50 and the amount of the moment to which the delivery tray 50 is provided while the delivery tray 50 was automatically unfolded, or folded.

Next, referring to FIGS. 1-7, the steps through which the delivery tray 50 is automatically unfolded will be described. As a recording start command is issued when the delivery tray 50 is in the folded position, the aforementioned operation for feeding recording mediums, and operation for properly positioning the recording mediums which are being conveyed askew, are started. Then, after the completion of these two operations, the driving of the sheet conveyance motor 37 is started. Thus, the sheet conveyer roller 30 and sheet discharger roller 33 are rotationally driven by the sheet conveyance motor 37 as the driving force source. As a result, the sheet discharger roller gear 36, which is integral with the sheet discharger roller 33, is rotationally driven (FIG. 3). As the sheet discharger roller gear 36 rotates, the cam portion 36*b* (first cam portion) of the sheet discharger roller gear 36 presses the tip portion of the trigger lever 63, which is the cam follower portion of the trigger lever 63. As a result, the trigger lever 63 is pushed downward. Thus, the trigger lever 63 rotates into the position in which it begins to rotate the primary lever 60 in the clockwise direction against the force from the spring 61; in other words, the trigger lever 63 is rotated into the position, beyond which it rotates the primary lever 60 in the direction to elastically deform the spring 61, as shown in FIG. 3.

Thus, as the sheet discharger roller gear 36 is further rotated, the tip portion of the trigger lever 63 moves onto the functional surface (peripheral surface) of the cam portion 36*b* while the trigger lever 63 is rotationally displaced in the clockwise direction, as shown in FIG. 4. This rotational displacement of the trigger lever 63 in the clockwise direction causes the hook catching portion 60*a* to disengage from the hook portion 50*d*, and then, the front arm portion of the pusher spring 65 which is in the elastically deformed state pushes the hook portion 50*d* outward. As a result, the delivery tray 50 is rotationally pushed away from the apparatus main assembly, into the position shown in FIG. 4. Incidentally, if there are obstacles in front of the delivery tray 50 and/or delivery tray 50 is held, the arm portion of the pusher spring 65 absorbs external force by elastically deforming. Therefore, the components, such as the primary lever 60, which make up the mechanism for folding or unfolding the delivery tray 50, are not damaged. The primary lever 60 and trigger lever 63 make up the driving force transmitting means which unlocks the locking means 60*a* and 50*d* by being moved by the rotational movement of the sheet discharger roller gear 36.

As the delivery tray 50 is pushed outward into the position (angle) shown in FIG. 4, the center of gravity G of the delivery tray 50 shifts frontward of the axial line of the shaft portion 50*a*, which coincides with the rotational axis of the delivery tray 50. Thus, the delivery tray 50 is rotated by the moment provided by its own weight in the unfolding direction to the position (FIG. 5) where the cam portion 50*c* comes into contact with the roller 62 (cam follower portion). Then, the delivery tray 50 is further rotated by the moment provided by its own weight, with the roller 62 rolling on the cam portion 50*c*, until it reaches the position (unfolded position) shown in FIG. 6. During this rotational movement of the delivery tray 50, the roller 62 rolls on the cam portion 50*c*, and the primary lever 60 is rotationally moved further in the direction (clockwise direction shown in drawing) to elastically deform the spring 61 (FIG. 6). As the spring 61 is elastically deformed, the force which is applied to the delivery tray 50 in the direction to fold the delivery tray 50 by the spring 61 increases. The amount of this force is smaller than the amount of moment provided by the weight of the delivery tray 50 itself. However, the mechanism for folding or unfolding the delivery tray 50 is designed so that as the delivery tray 50 is rotationally moved in the unfolding direction, this force which acts on the delivery tray 50 in the direction to fold the delivery tray 50 increases in a manner to follow a preset curve. This will be described later in detail.

Further, during this period, the delivery tray 50 is rotated by the moment provided by its own weight, causing the primary lever 60 and trigger lever 63 to rotate in the clockwise direction indicated by the arrow mark in the drawings, through the cam portion 50*c* (third cam portion) and roller 62. As a result, the trigger lever 63 separates from the cam portion 36*b* (first cam portion) of the sheet discharger roller gear 36, as shown in FIG. 6. The cam portion 50*c* of the delivery tray 50 and the roller 62 of the primary lever 60 make up the means for moving forward or backward the primary lever 60 and trigger lever 63, which make up the driving force transmitting means, relative to the sheet discharger roller gear 36 which is the driving means on the apparatus main assembly side.

Further, in this embodiment, the mechanism for rotationally moving (folding or unfolding) the delivery tray 50 is structured so that when the delivery tray 50 is in the folded position, the locking means (hook catching means 60*a* and hook portion 50*d*) is unlocked by the sheet discharger roller gear 36. Further, it is structured so that the primary lever 60 and trigger lever 63 are moved away from the sheet discharger roller gear 36 by the rotational movement of the delivery tray 50. The above described process in which the delivery tray 50 automatically unfolds ends before the recording medium S is conveyed to the image formation position on the platen 32. Therefore, the variation in the torque, vibrations, etc., which occur while recording is made do not adversely affect the operation for automatically unfolding the delivery tray 50.

Shown in FIG. 7 is the moment with which the delivery tray 50 is provided in the operation for automatically unfolding the delivery tray 50. In FIG. 7, the horizontal axis represents the angle of the delivery tray 50, and the vertical axis represents the amount of the moment, with respect to the rotational axis 50*a*, with which the delivery tray 50 is provided. The fine line represents the amount of moment with which the delivery tray 50 is provided by its own weight (which hereafter may be referred to as self-weight moment). The thick grey line represents the amount of the additional moment with which the delivery tray 50 is provided by the delivery tray moving (folding or unfolding) mechanism, made up of the primary lever 60, etc. Further, the thick black line represents the total amount of moment, that is, the sum of (difference between) the self-weight moment and additional moment.

First, the self-weight moment, which is represented by the fine line, will be described. When the delivery tray 50 is in the folded position, the center of gravity G of the delivery tray 50 is slightly behind the rotational axis of the shaft portion 50*a*. Therefore, the self-weight moment acts in the direction to keep the delivery tray 50 folded, and is very small. As the operation for automatically unfolding the delivery tray 50 begins, the delivery tray 50 is rotationally pushed away from the apparatus main assembly by the pusher spring 65. When the delivery tray 50 is in the position shown in FIG. 4, the self-weight moment with respect to the shaft portion 50*a* is opposite in direction from when the delivery tray 50 is in the folded position; the self-weight moment acts in the direction to unfold the delivery tray 50. As the attitude of the delivery tray 50 further changes in the direction to unfold, the position of the center of gravity G further moves frontward away from the rotational axis of the delivery tray 50. Therefore, as the delivery tray 50 further unfolds, the self-weight moment keeps on increasing in a manner of following the so-called "sign curve (sinusoidal curve)", until the delivery tray 50 completely unfolds.

Next, the external force, which is represented by the thick grey line, will be described. When the delivery tray 50 is in the folded state, it remains locked in place by the moment with which the delivery tray 50 is provided by the pressure applied to the hook portion 50*d* (second cam portion) by the spring 61 of the primary lever 60 through the hook catching portion 60*a*, and which acts in the direction to fold the tray 50; the amount of this moment has a value of "a". As the operation for automatically opening the delivery tray 50 is started, the pressure is eliminated from the hook catching portion 60*a* by the interaction between the cam portion 36*b* (first cam portion) of the sheet discharger roller gear 36 and the trigger lever 63. Thus, the external force which acts on the delivery tray 50 is only the force generated by the pusher spring 65 in the direction to move the delivery tray 50 away from the apparatus main assembly, and this force has a very small value of "b". Then, as the delivery tray 50 is rotationally pushed away slightly from the apparatus main assembly by the pusher spring 65, that is, when the delivery tray 50 is in the position shown in FIG. 4, a small amount of external force, the value of which is "c", is applied to the delivery tray 50 by the pusher spring 65 in the direction to unfold the delivery tray 50. Then, the moment the delivery tray 50 separates from the pusher spring 65, the external force becomes zero.

Then, as the delivery tray 50 is rotationally unfolded into the mid position, shown in FIG. 5, by the self-weight moment, the cam portion 50*c* (third cam portion) of the delivery tray 50 comes into contact with the roller 62 of the primary lever 60, and begins to be pressed by the roller 62. As the cam portion 50*c* comes into contact with the roller 62, the delivery tray 50 begins to be subjected to the external force which acts in the direction to fold the delivery tray 50, and the value of which is "d". As the attitude of the delivery tray 50 changes in the direction to unfold the delivery tray 50, this external force which acts in the direction to fold the delivery tray continues to increase after the contact between the cam portion 50*c* and the roller 62 of the primary lever 60, as shown in FIG. 7. The amount of the external force which acts on the delivery tray 50 in the direction to fold the delivery tray 50 when the delivery tray 50 is in the completely unfolded state has a value of "e".

Next, the overall amount of the moment with which the delivery tray 50 is provided, and which is represented by the thick black line will be described. Ignoring the resistance such as frictional resistance, the overall amount of moment means the actual amount of moment with which the delivery tray 50 is provided. When the delivery tray 50 is in the folded state, the overall amount of moment has a value large enough to keep the delivery tray 50 in the folded state. As the operation for unfolding the delivery tray 50 is started, the direction in which the overall amount of moment acts on the delivery tray 50 reverses from the direction to fold the delivery tray 50 to the direction to unfold the delivery tray 50. Then, until the delivery tray 50 rotates to the position, shown in FIG. 4, beyond which the weight of the delivery tray 50 itself is sufficient to rotate the delivery tray 50 in the direction to unfold the delivery tray 50, the overall moment keeps on acting in the direction to unfold the delivery tray 50, and has a value sufficient to rotate the delivery tray 50 in the unfolding direction.

While the delivery tray 50 is in the transitional state between the state shown in FIG. 4 and the state shown in FIG. 5, the overall moment is equal to the self-weight moment that acts in the direction to unfold the delivery tray 50, and its value gradually increases. While the delivery tray 50 is in the transitional state between the state shown in FIG. 5 and the completely unfolded state shown in FIG. 1, the overall moment with which the delivery tray 50 is provided is the difference between the self-weight moment and the external force, being therefore such a moment that acts in the direction to unfold the delivery tray 50. Therefore, it is roughly stable and has a very small value of "f". That is, the mechanism for rotationally moving (unfolding or folding) the delivery tray 50 is structured so that the rotational speed of the delivery tray 50 is adjusted by applying to the delivery tray 50 a rotational force, the amount of which corresponds to the change in the attitude of the delivery tray 50, with the use of the cam portion 50*c* of the delivery tray 50 and the roller 62 of the primary lever 60. Incidentally, when the delivery tray 50 is in the completely folded state and completely unfolded state, the delivery tray 50 is subjected to the regulatory force generated by the slot 50*b* and projection 10*b*. Therefore, the value of the moment which acts on the delivery tray 50 is "0", and therefore, the delivery tray 50 remains stationary.

In the case of this embodiment described above, not only does the delivery tray 50 automatically and smoothly unfold, but also, at a slower speed than the delivery tray 50 in accordance with the prior art, being therefore substantially smaller in the amount of the impact which occurs at the end of the unfolding of the delivery tray 50, and the noises resulting from the impact. Further, when the delivery tray 50 is in the folded state, the trigger lever 63 is not in contact with the first cam portion 36*b* of the sheet discharger roller gear 36. Therefore, even if the sheet discharger roller gear 36 is rotated in response to a recording start command issued when the delivery tray 50 is in the unfolded state, the sheet discharger roller gear 36 and trigger lever 63 do not come into contact with each other, and therefore, the delivery tray 50 remains stationary (delivery tray does not change in status). Further, the delivery tray 50 can be easily unfolded or folded as necessary simply by grasping the handhold portion 50*e* of the delivery tray 50.

Figure 8:
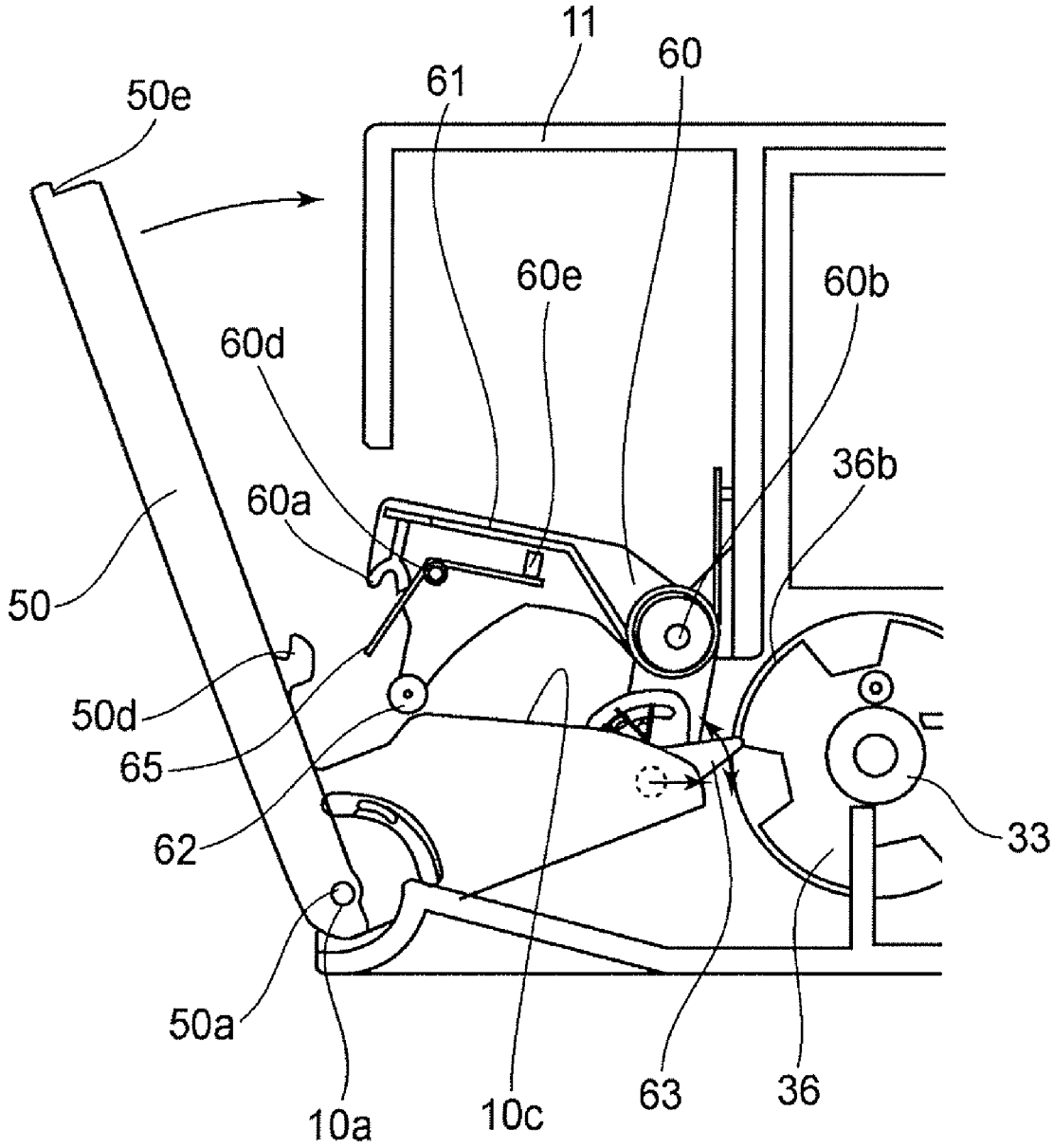
FIG. 8 is a vertical sectional view of the delivery tray of the recording apparatus, in the first preferred embodiment of the present invention, which is being rotated toward the apparatus main assembly about its hinge portion, that is, in the direction in which it is to be folded, and the components related to the tray operation.
Figure 9:
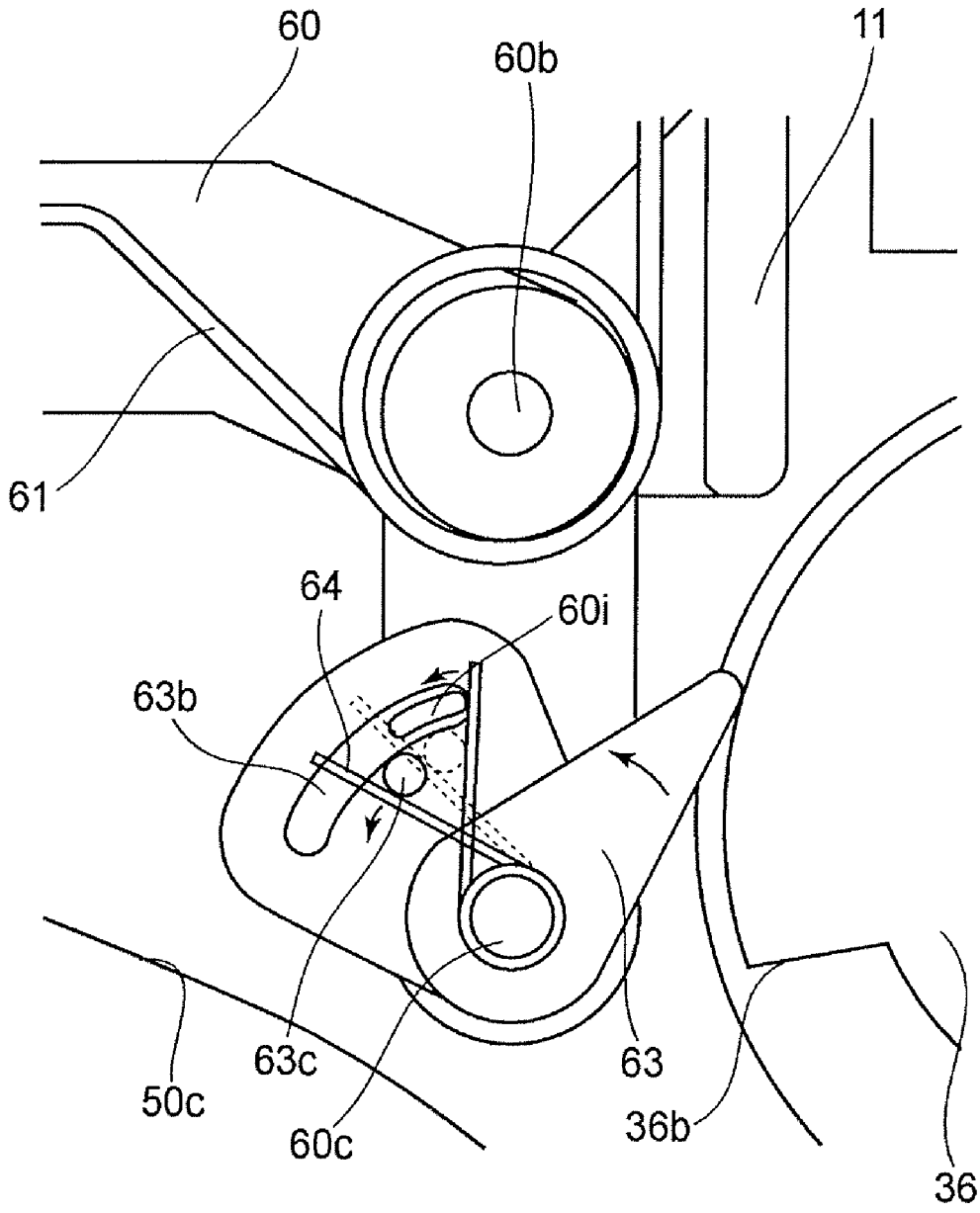
FIG. 9 is a vertical and partially sectional view of the trigger lever, sheet discharger roller gears, and the adjacencies thereof, showing their states during the rotation of the trigger lever by the sheet discharger roller gear in the counterclockwise direction shown in the drawing.
Figure 10:
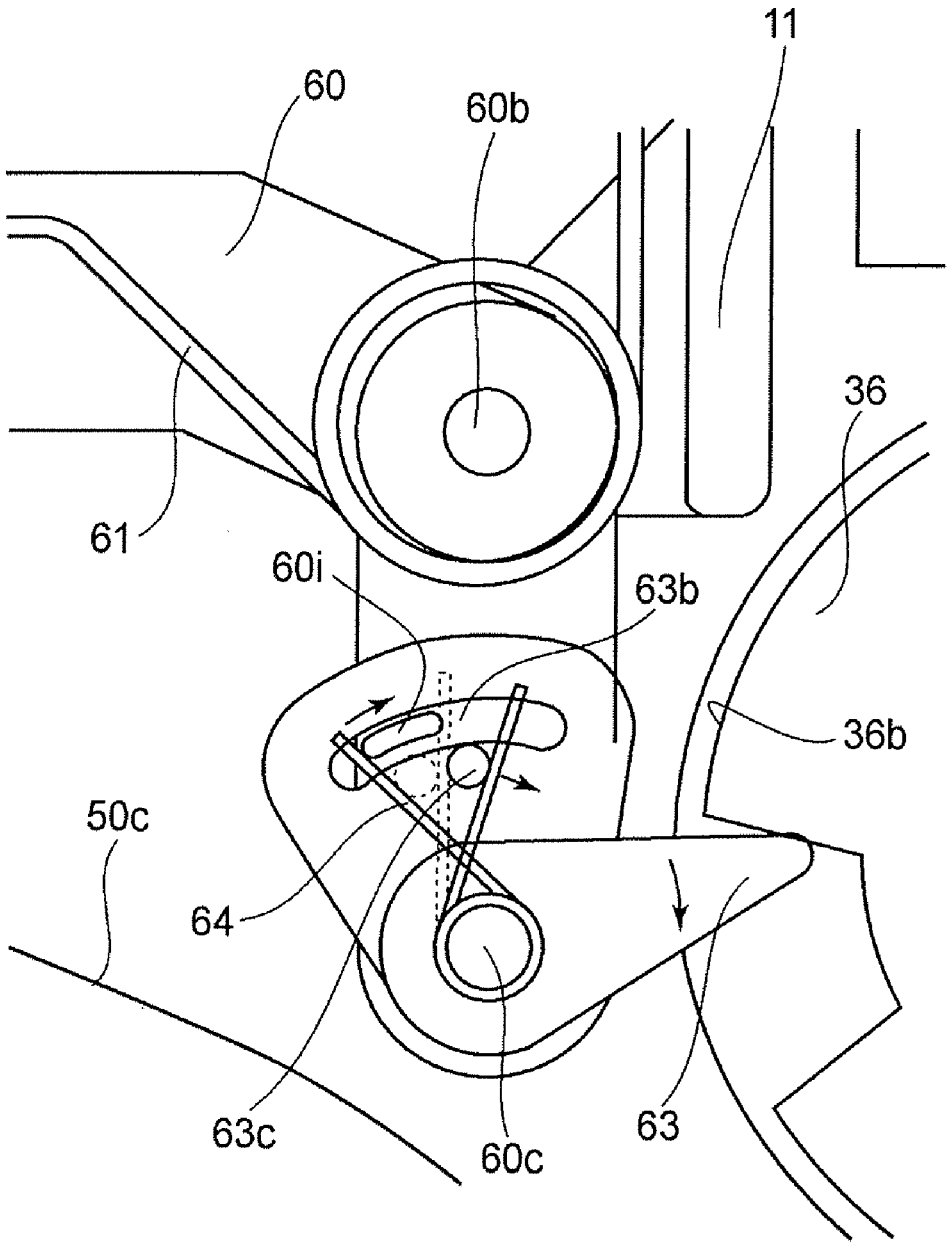
FIG. 10 is a vertical and partially sectional view of the trigger lever, sheet discharger roller gears, and the adjacencies thereof, showing their states during the rotation of the trigger lever by the sheet discharger roller gear in the clockwise direction shown in the drawing.

FIG. 8 is a vertical sectional view of the delivery tray 50 and the components related to the unfolding and folding of the delivery tray 50, which are in the state in which the delivery tray 50 is being folded. FIG. 9 is a vertical and partially sectional view of the trigger lever 63, sheet discharger roller gear 36, and the adjacencies thereof, which are in the state in which the trigger lever 63 is being rotated in the counterclockwise direction, shown in the drawing, by the sheet discharger roller gear 36. FIG. 10 is a vertical and partially sectional view of the trigger lever 63, sheet discharger roller gear 36, and the adjacencies thereof, which are in the state in which the trigger lever 63 is being rotated in the clockwise direction, shown in the drawing, by the sheet discharger roller gear 36. Referring to FIGS. 8-10, the trigger lever 63 sometimes comes into contact with the edge of the contact surface of the cam portion 36*b* of the sheet discharger roller gear 36 as shown in FIG. 8 (when cam portion 36*b* of sheet discharger roller gear 36 is at a specific location). In the case of this embodiment, it is unpredictable whether the trigger lever 63 will rotate in the direction shown in FIG. 9 or 10 in the abovementioned situation. Regardless of the direction in which the trigger lever 63 rotates, the primary lever 60 is provided with a moment which acts in the direction to rotate the primary lever 60 in the clockwise direction, shown in the drawing, about the shaft portion 50*a*. Therefore, regardless of the direction in which the trigger lever 63 rotates in the abovementioned situation, the problem that the unfolding or folding of the delivery tray 50 is interfered with, by the abovementioned manner of contact between the sheet discharger roller gear 36 and trigger lever 63 does not occur: for example, the abovementioned manner of contact between the sheet discharger roller gear 36 and trigger lever 63 does not cause the delivery tray 50 to be unsatisfactorily unfolded or folded.

Also in this embodiment, the sheet discharger roller gear 36 is provided with the cam portions 36*b* having multiple sections which are distributed with equal intervals in the circumferential direction of the sheet discharger roller gear 36. Therefore, if the sheet discharger roller gear 36 rotates in response to a recording start signal issued while the delivery tray 50 is in the folded state, and the trigger lever 63 is on the functional surface of one of multiple sections of the cam portions 36*b* as shown in FIG. 9, the mechanism for unfolding or folding the delivery tray 50 reacts in the following manner. That is, first, as the sheet discharger roller gear 36 rotates, the tip portion of the trigger lever 63 is freed from the cam portion 36*b* with which it has been in contact, by the arrival of the interval between the section of the cam portion 36*b*, with which the trigger portion 63 has been in contact, and the next section of the cam portion 36*b*. Then, as the tip portion of the trigger lever 63 becomes free, the trigger lever 63 is temporarily returned to the center position shown in FIG. 2, and then, the operation for automatically unfolding the delivery tray 50 is continued. As described above, the sheet discharger roller gear 36 is provided with the cam portions 36*b* having multiple sections which are distributed with equal intervals in the circumferential direction of the sheet discharger roller gear 36. Therefore, the operation for automatically unfolding the delivery tray 50 can be completed before the recording medium S is delivered to the image formation position on the platen 32. Therefore, the operation for automatically unfolding the delivery tray 50 is not adversely affected by the variation in torque and/or vibrations resulting from a recording operation.

Also in this embodiment, as an operator moves the delivery tray 50 in the direction to unfold the delivery tray 50, by holding the handhold portion 50 of the delivery tray 50, the primary lever 60 is rotated in the clockwise direction, shown in the drawing, by the moment with which the primary lever 60 is provided by this initial action in the delivery tray unfolding operation. As a result, the hook catching portion 60*a* is disengaged from the hook portion 50*d*.

Also in this embodiment described above, the mechanism for automatically and rotationally moving (folding or unfolding) the delivery tray 50 is not provided with a drive force source dedicated therefor, and also, is not specifically driven for unfolding or folding the delivery tray 50. In other words, the driving force source (sheet conveyance motor, or the like) necessary for the apparatus main assembly to carry out a recording operation, and the sheet driving means (sheet conveyer roller 30, sheet discharger roller 33, etc.) are utilized to carry out the operation for automatically unfolding the delivery tray 50.

Embodiment 2

Figure 11:
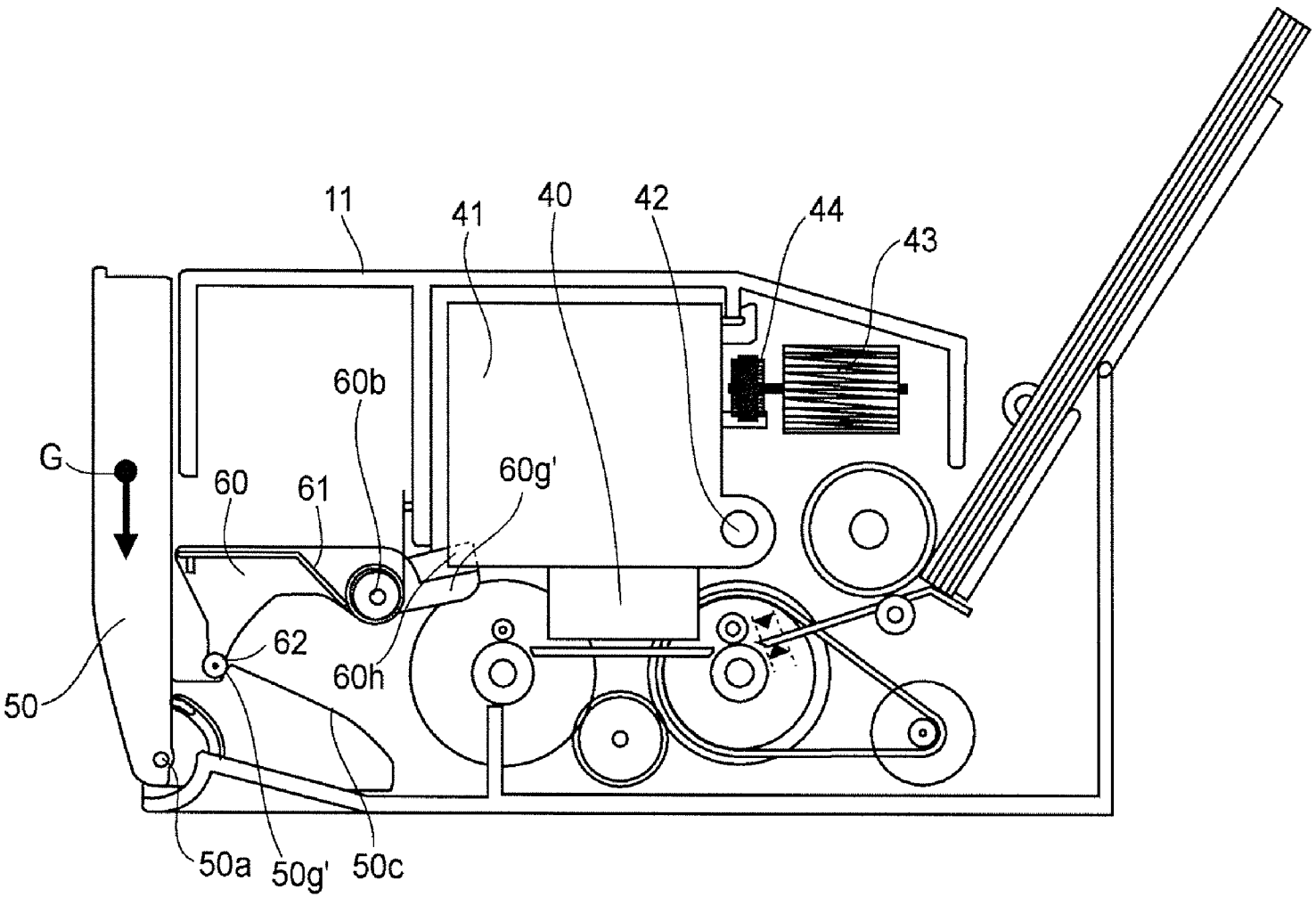
FIG. 11 is a vertical sectional view of the delivery tray of the recording apparatus, in the second preferred embodiment of the present invention, which is in the folded state, and the components related to the tray operation.
Figure 12:
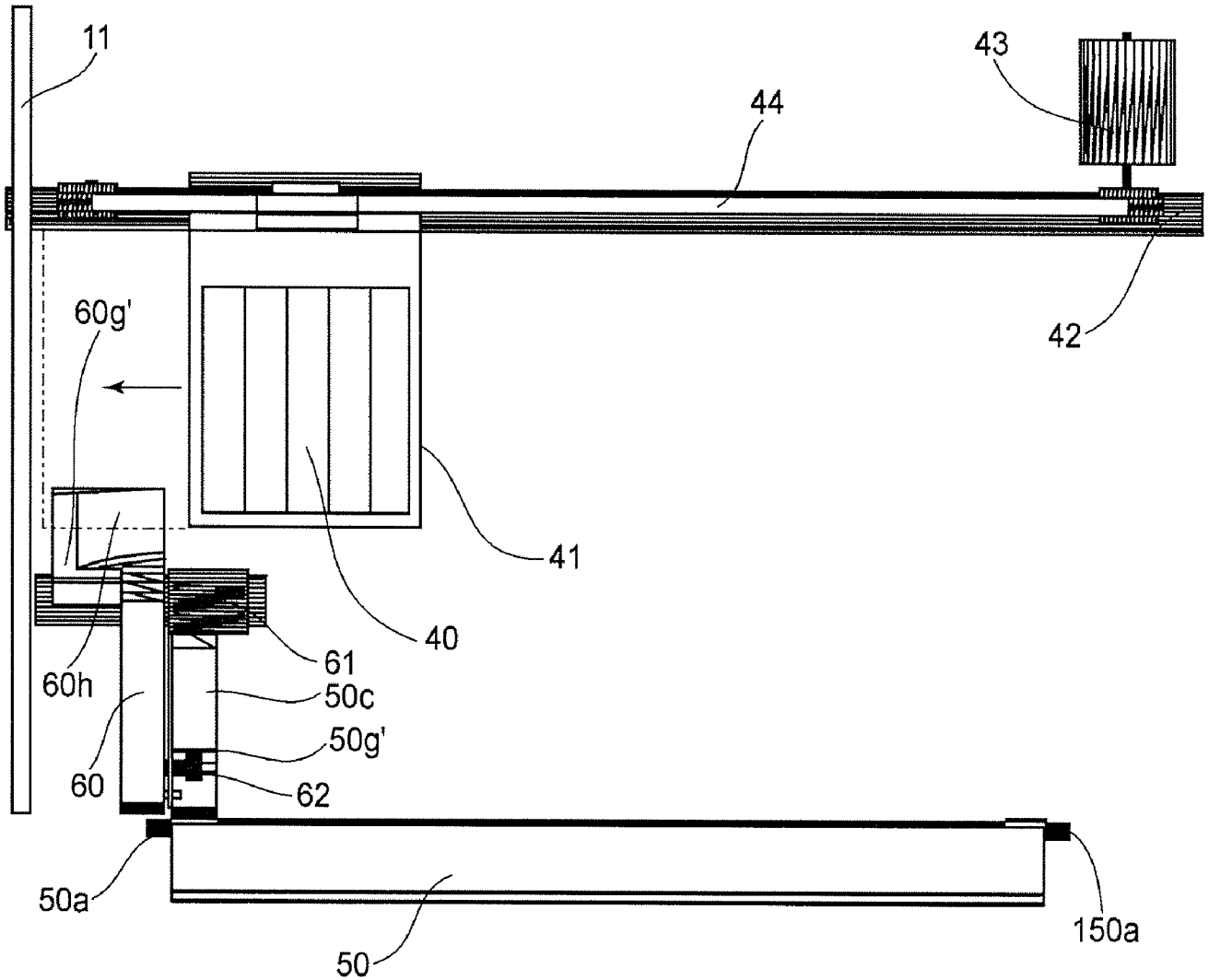
FIG. 12 is a top plan view of the mechanism for folding or unfolding the delivery tray.
Figure 13:
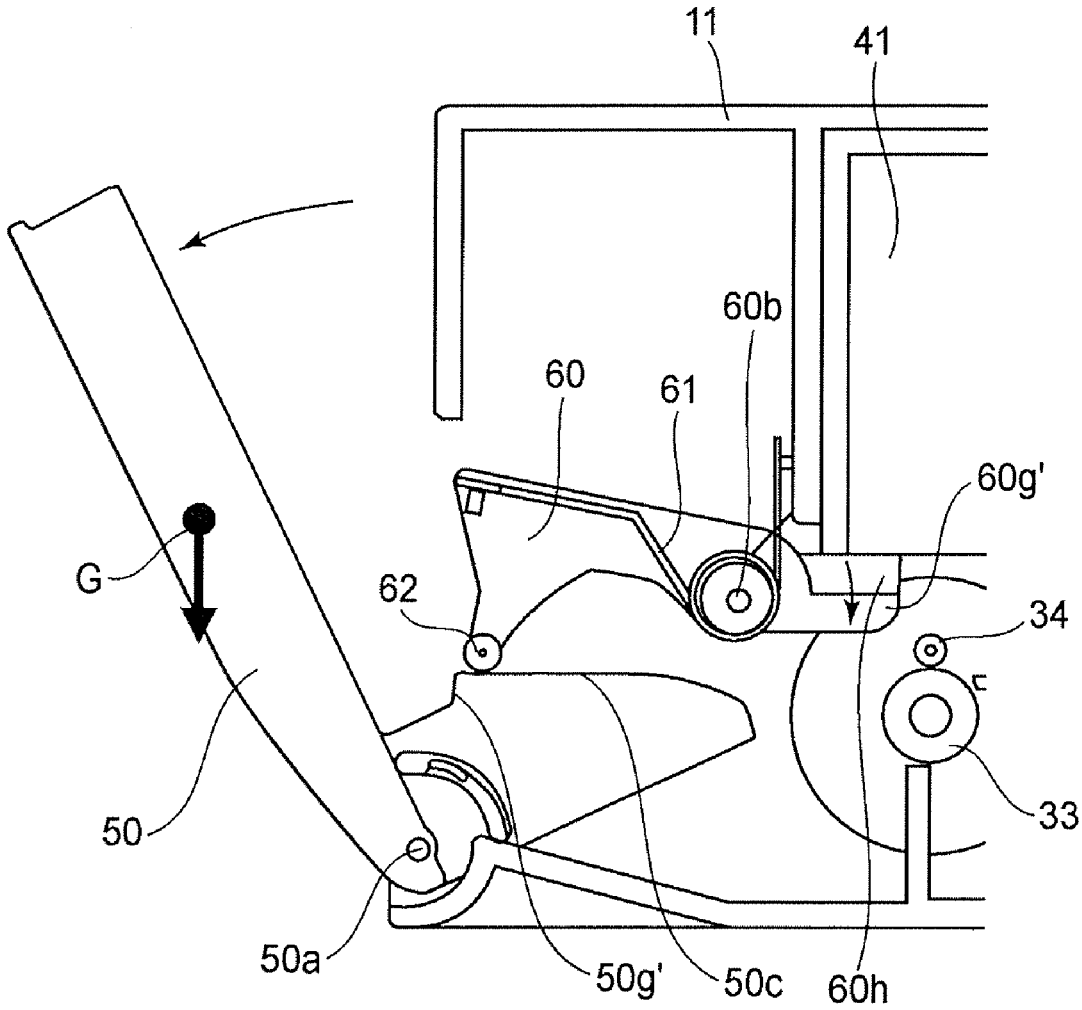
FIG. 13 is a vertical sectional view of the delivery tray, which is in the halfway unfolded state.
Figure 14:
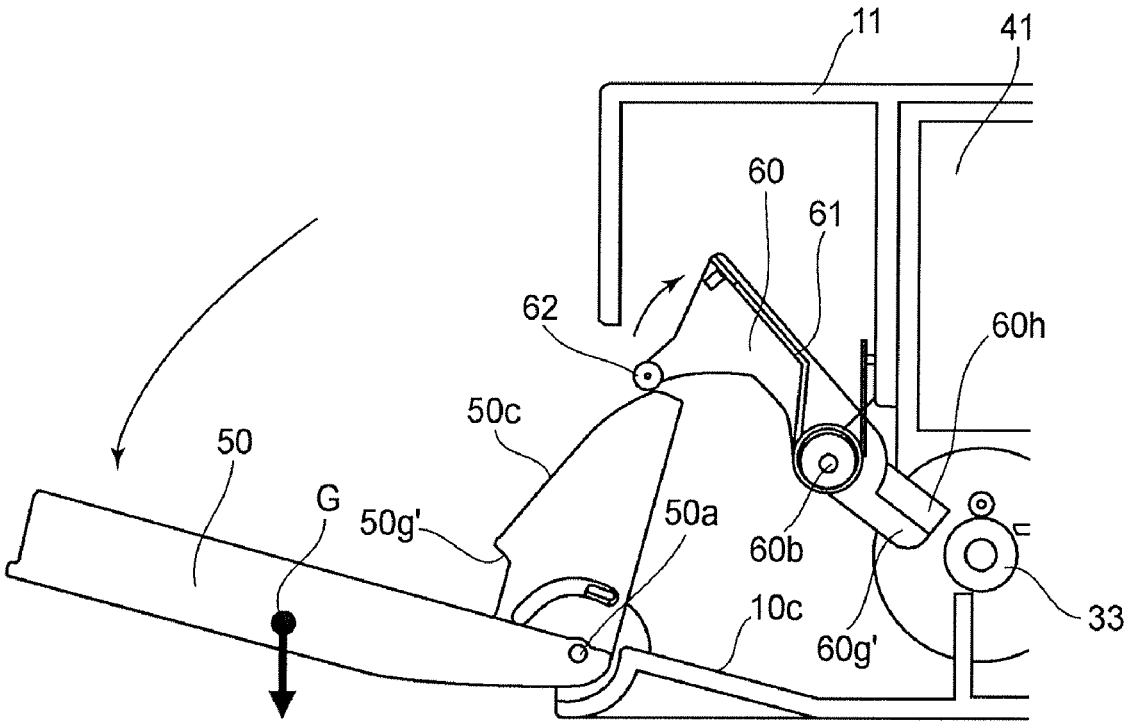
FIG. 14 is a vertical sectional view of the delivery tray, which is in the fully unfolded state.

Next, referring to FIGS. 11-14, the second preferred embodiment of the present invention will be described. FIG. 11 is a vertical sectional view of the recording apparatus in the second embodiment of the present invention, the delivery tray of which is in the folded state. FIG. 12 is a top plan view of the mechanism for unfolding and unfolding the delivery tray. FIG. 13 is a vertical sectional view of the delivery tray which is being unfolded, and the components related to the operation of the delivery tray. FIG. 14 is a vertical sectional view of the delivery tray which is in the completely unfolded state, and the components relate to the operation of the delivery tray. The center of gravity G of the delivery tray 50 in this embodiment is on the frontward side of the center of gravity G of the delivery tray 50 in the first embodiment. In this embodiment, therefore, the moment of the delivery tray 50 attributable to the weight of the delivery tray 50 itself acts in the direction to unfold the delivery tray 50 even when the delivery tray 50 is in the completely unfolded state. In the case of a structural arrangement such as this one, it is unnecessary to push the delivery tray 50 away from the apparatus main assembly during the operation for automatically unfolding the delivery tray 50. That is, all that is necessary to initiate the operation for automatically unfolding the delivery tray 50 is to unlock the delivery tray 50 from the apparatus main assembly. In other words, a component equivalent to the pusher spring 65 in the first embodiment is unnecessary.

In the first embodiment, when the delivery tray 50 is in the completely folded state, the delivery tray 50 was kept held to the apparatus main assembly by keeping the hook portion 50*d* of the delivery tray 50 engaged with the hook catching portion 60*a* of the primary lever 60 by utilizing the force generated by the spring 61. In comparison, in this embodiment, when the delivery tray 50 is in the completely folded state, the delivery tray 50 is kept held to the apparatus main assembly by keeping the roller 62 of the primary lever 60 in contact with the tray locking slant surface portion 50*g* of the delivery tray 50, as shown in FIG. 11. Further, the primary lever 60 in this embodiment is provided with an arm portion 60*g* having a slant surface 60*h*, instead of the trigger lever 63 in the first embodiment. This arm portion 60*g* extends rearward so that it can be engaged with the bottom surface of the carriage 41, as shown in the drawing.

Thus, as the carriage 41 is moved to the end of the moving range of the carriage 41, which is on the side of the mechanism for unfolding or folding the delivery tray, that is, the position indicated by a double-dot chain line in FIG. 12, the slanted surface of the arm portion 60*a* is pressed by the carriage 41. Therefore, the primary lever 60 is rotationally moved in the clockwise direction, shown in the drawing, about the shaft portion 60*a*. Therefore, the roller 62 of the lever 60 moves upward as shown in FIG. 13. The carriage 41 has a regulatory function similar to the regulatory function of the cam portion 36*b* (first cam portion) of the sheet discharger roller gear 36 in the first embodiment, and the arm portion 60*b* functions as the cam follower which follows the bottom surface of the carriage 41 which functions as a cam. As the roller 62 moves upward, the delivery tray 50 becomes unlocked from the apparatus main assembly, being thereby allowed to be rotated by its own weight to the midway point shown FIG. 13. As the delivery tray 50 moves into the position shown in FIG. 13, the cam portion 50*c* (second cam portion) of the delivery tray 50 comes into contact with the roller 62. In this embodiment, the locking means for keeping the delivery tray 50 in the completely folded state is made up of the delivery tray locking slanted surface portion 50*g* and the roller 62. Further, the primary lever 60 makes up the driving force transmitting means which is moved by the movement of the carriage 41, as the driving means on the apparatus main assembly side, to disengage the delivery tray locking means made up of the delivery tray locking slanted surface portion 50*g* and roller 62.

As the cam portion 50*c* comes into contact with the roller 62, the delivery tray 50 rotates further in the unfolding direction due to its own weight, as in the first embodiment, until it becomes completely unfolded as shown in FIG. 14. While the state of the delivery tray 50 changes from the state shown in FIG. 13 to the completely unfolded state shown in FIG. 14, the roller 62 rolls on the cam portion 50*c*, and the primary lever 60 is rotationally moved in the direction to resiliently deform the spring 61 (clockwise direction shown in drawing), as in the first embodiment. That is, the delivery tray 50 is rotationally moved in the unfolding direction at a gentle speed by the difference between the self-weight moment of the delivery tray 50 and the external force attributable to the spring 61, while rotating the primary lever 60 in the direction to elastically deforming the spring 61. Thus, the moment which acts on the delivery tray 50 in the direction to fold the delivery tray 50 continuously increases until the delivery tray 50 is completely unfolded.

Further, while the delivery tray 50 is rotated from the position shown in FIG. 13 to the position shown in FIG. 14, the primary lever 60 is rotated in the clockwise direction, shown in the drawing, by the self-weight moment of the delivery tray 50 through the cam portion 50*c*. Therefore, the arm portion 60*g* retracts from the moving range of the carriage 41 (in particular, section in which arm portion 60*g* can engage with carriage 41). That is, also in this embodiment, the cam portion 50*c* of the delivery tray 50 and the roller 62 of the primary lever 60 make up the means for advancing or retracting the primary lever 60, which is the driving force transmitting means, relative to the carriage 41, which is the driving means on the apparatus main assembly side, in response to the change in the attitude of the delivery tray 50. Further, the mechanism for rotationally moving (unfolding or folding) the delivery tray 50 is structured so that when the delivery tray 50 is in the folded state, the locking means (delivery tray locking slanted surface portion 50*g* and roller 62) is disengaged from the delivery tray 50 by the carriage 41, and also, so that the primary lever 60 is moved away from the carriage 41 by the movement of the delivery tray 50. Further, the mechanism is structured so that the rotational speed of the delivery tray 50 is adjusted by countering the moment of the delivery tray 50, which is affected by the change in the attitude of the delivery tray 50, with the external force which the interaction between the cam portion 50*c* of the delivery tray 50 and the roller 62 of the primary lever 60 generates.

Except for the features described above, the means for unfolding or folding the delivery tray, in the second embodiment, is practically the same in structure and function as that in the first embodiment. Therefore, the second embodiment also can optimize the amount of the moment with which the delivery tray 50 is provided while the delivery tray 50 is unfolded, as can the first embodiment. That is, compared to the delivery tray controlling means in accordance with the prior art, the delivery tray controlling means in the second embodiment also can substantially reduce the speed at which the delivery tray 50 automatically unfolds, and therefore, can substantially reduce the amount of the impact which occurs at the end of the unfolding of the delivery tray, and the amount of noises attributable to the impact. Further, in the case of this embodiment, the delivery tray controlling means does not require a driving force source dedicated to the unfolding of the delivery tray, and an operation dedicated to the unfolding of the delivery tray. In other words, the delivery tray can be automatically unfolded by utilizing the operations which are carried out by the apparatus main assembly to record an image, and the driving force source necessary for recording.

Further, in the second embodiment, it is unnecessary to move the carriage 41 by an additional distance to allow the delivery tray to unfold itself. Therefore, it does not occur that the carriage 41 is adversely affected by the unfolding of the delivery tray; the unfolding of the delivery tray does not affect the torque for driving the carriage 41, and the vibrations which occur at the end of the unfolding of the delivery tray do not adversely affect the carriage 41 during a recording operation. Further, it is unnecessary to increase in size the recording apparatus. Incidentally, the operation for moving the carriage 41 to the position indicated by the double-dot chain line in FIG. 12 has to be carried out between when a recording start command is received and when the carriage 41 begins to be moved for recording.

Incidentally, in the preceding embodiments, the recording apparatuses were ink jet recording apparatuses. However, the application of the present invention is not limited to ink jet recording apparatuses. That is, the present invention is also applicable to recording apparatuses of various types, for example, the laser beam type, thermal transfer type, thermal element type, wire-dot type, etc., just as effectively as it is to ink jet recording apparatuses.

Each of the preceding embodiments of the present invention makes it possible to optimize the amount of the moment with which the delivery tray is provided when it is unfolded. Further, not only do they allow the delivery tray to unfold itself, but also, they reduce the speed at which the delivery tray unfolds, reducing thereby the impact which occurs at the end of the unfolding of the delivery tray.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 226565/2006 filed Aug. 23, 2006, which is hereby incorporated by reference.

What is claimed is:

1. A recording apparatus comprising:

a discharging roller for discharging, from a main assembly of said recording apparatus, a recording material having been subjected to a recording operation by recording means;

an openable and closable sheet discharge tray for supporting the recording material discharged by said discharging roller, and for covering the discharge roller when the sheet discharge tray is closed;

urging means for urging said sheet discharge tray in a direction opening said sheet discharge tray;

locking means for holding said sheet discharge tray at a closed position;

driving means for driving the discharging roller;

drive transmitting means for transmitting a driving force of the driving means to release said locking means; and advancing and retracting means for retracting said drive transmitting means to a position where the drive transmitting means does not transmit the driving force of the driving means when the discharge tray is opened, wherein said sheet discharge tray is opened by a weight of said sheet discharge tray and an urging force of the urging means when the drive transmitting means transmits the driving force of the driving means to release said locking means.

2. The apparatus according to claim 1, wherein said advancing and retracting means applies a rotation moment to said sheet discharge tray correspondingly to a change of an attitude of said sheet discharge tray so that rotational speed of said sheet discharge tray is adjusted.

3. The apparatus according to claim 1, wherein said driving means comprises a first cam portion, said sheet discharging tray includes a second cam portion and third cam portion, a swingable lever having one end portion provided with a cam follower portion engageable with said first cam portion and the other end portion a cam follower portion engageable with said second cam portion and said third cam portion, wherein said first cam portion is effective to rotate said swingable lever to release said sheet discharge tray from said second cam portion, and said third cam portion further rotates said swingable lever to retract said cam follower portion away from said first cam portion while applying to said sheet discharge tray a rotation moment which is interrelated with an attitude of said sheet discharge tray.

4. The apparatus according to claim 1, wherein said recording means includes ink jet recording means for effecting recording by ejecting to the recording material on the basis of image information.

* * * * *